United States Patent [19]

Dodds et al.

[11] Patent Number: 4,654,616

[45] Date of Patent: Mar. 31, 1987

[54] BLUE BOW CORRECTION FOR CRT RASTER

[75] Inventors: Dennis L. Dodds, Indianapolis, Ind.; Joseph L. Werst, Lancaster, Pa.

[73] Assignee: RCA Corporation, Princeton, N.J.

[21] Appl. No.: 782,138

[22] Filed: Sep. 30, 1985

[51] Int. Cl.[4] ..... H01F 1/00

[52] U.S. Cl. ..... 335/212; 313/427

[58] Field of Search ..... 335/210, 212; 313/421, 313/426, 427, 428

[56] References Cited

U.S. PATENT DOCUMENTS 4,145,677 3/1979 Maruyama et al. ..... 335/212
4,162,470 7/1979 Smith ..... 335/210
4,232,283 11/1980 Werst ..... 335/212
4,253,078 2/1981 Tagawa et al. ..... 335/212
4,388,602 6/1983 Dodds ..... 335/212

*Primary Examiner*—George Harris
*Attorney, Agent, or Firm*—Paul J. Rasmussen; Joseph Laks; Scott J. Stevens

[57] ABSTRACT

In a video display system in which a cathode ray tube exhibits blue bow misconvergence, a correction arrangement includes areas of magnetizable material located within recesses formed in the deflection yoke insulator. The material lies between the end turns of the horizontal coils along the sides of the yoke. The material is magnetized to form a four-pole field to effect correction of the blue bow error.

13 Claims, 6 Drawing Figures

BLUE BOW CORRECTION FOR CRT RASTER

This invention relates to video display apparatus and, in particular, to electron beam landing error correction for a video display apparatus cathode ray tube.

Cathode ray tubes used in color video display apparatus, such as television receivers or computer monitors, incorporate an electron gun assembly that typically produces three electron beams that respectively illuminate red, green and blue phosphor elements on a display screen of the cathode ray tube. The electron beams exit the electron gun assembly oriented in either a triangular, i.e., delta, configuration or horizontally aligned in an in-line configuration. The beams are deflected or scanned to form a raster on the cathode ray tube display screen by electromagnetic fields produced by deflection currents flowing in the deflection windings of a deflection yoke. In a self-converging deflection yoke, the magnetic fields produced by the deflection windings comprise field harmonics selected to produce substantial convergence of the three electron beams at all locations on the display screen. Proper performance of the self-converging yoke requires that beam purity and static or screen center convergence are correctly adjusted during assembly of the video display apparatus.

Purity and static convergence may be achieved by the use of a number of magnetized rings located at the rear of the deflection yoke, such as that described in U.S. Pat. No. 3,725,831, issued Apr. 3, 1973, in the name of R. L. Barbin and entitled "Magnetic Beam Adjusting Arrangements". The rings are adjustable to produce magnetic poles of particular strengths and orientation to provide the desired purity and convergence adjustment of the beams.

Purity and static convergence may also be achieved by the use of a strip of magnetizable material that is caused to be magnetized to form the desired magnetic poles. An arrangement of this type is described in U.S. Pat. No. 4,138,628, issued Feb. 6, 1979, in the name of J. L. Smith and entitled "Magnetizing Method for Use with a Cathode Ray Tube".

If the electron gun assembly is improperly mounted in the cathode ray tube during assembly such that the electron beams are not aligned with the horizontal deflection axis, but are slightly rotated, the scanned electron beams will exhibit a form of misconvergence at the ends of the horizontal axis, commonly referred to as "blue bow". This misconvergence becomes more serious for high resolution cathode ray tubes or for tubes having large (e.g., 110°) deflection angles. Blue bow is not readily corrected by the previously described purity and static convergence arrangements and additional means is required. Providing added magnetic rings or enlarging the magnetizable strip may be costly and the added components or material may not be easily accommodated on the tube neck.

In accordance with the present invention, a video display apparatus comprises a cathode ray tube having an electron gun apparatus that produces a number of electron beams. The electron gun apparatus is subject to alignment errors. A deflection yoke having horizontal and vertical deflection coils receives deflection signals that deflect the electron beams along horizontal and vertical deflection axes. The electron gun assembly alignment errors cause distortion of the electron beam deflection. An arrangement for correcting the distortion comprises magnetic material located on opposite sides of the cathode ray tube along the horizontal axis and adjacent to the rear of the horizontal deflection coil. The magnetic material is magnetized to produce a four pole magnetic field in the vicinity of the electron beams.

In the accompanying drawing.

Figure 1:
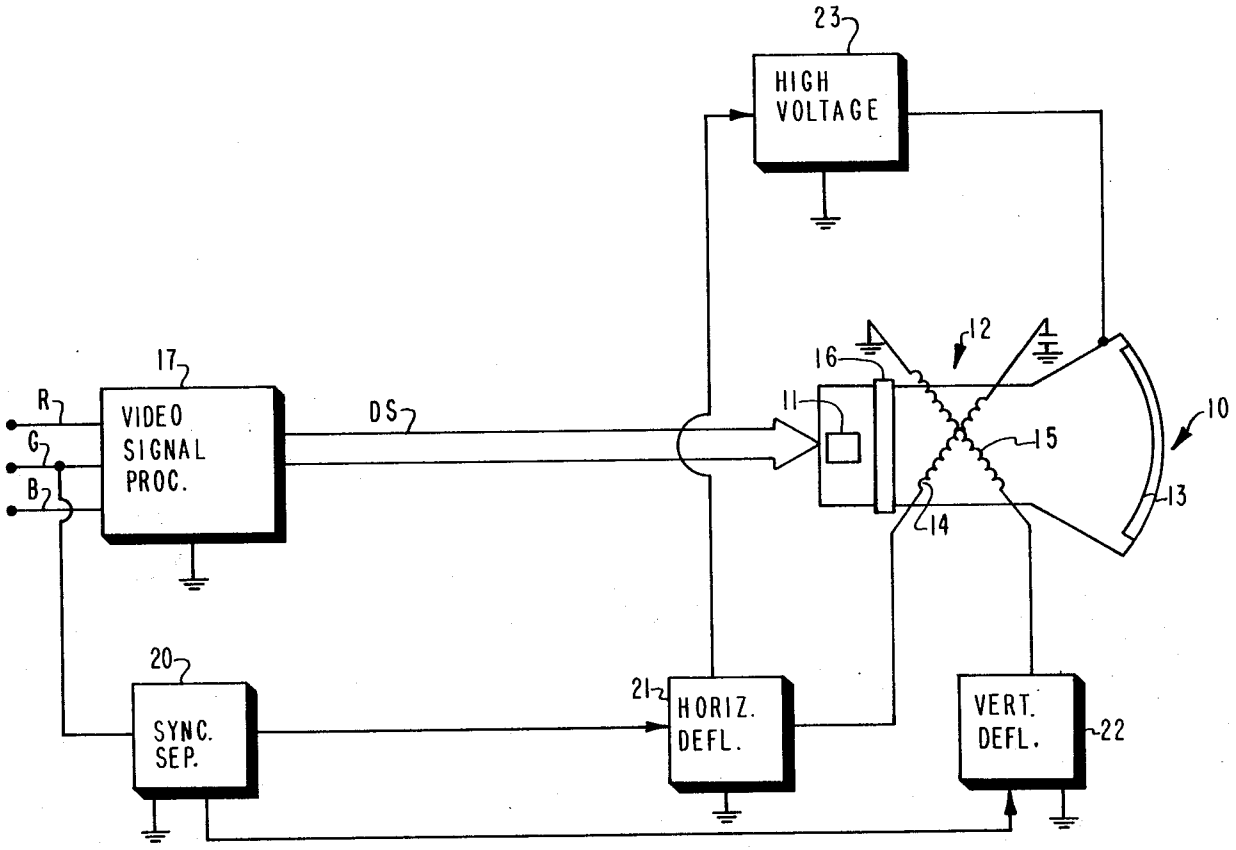
FIG. 1 is a schematic and block diagram of a portion of a video display apparatus.

Referring to FIG. 1, a video display apparatus includes a cathode ray tube 10 incorporating an electron gun assembly 11 mounted within the neck region of the tube. The electron gun assembly 11 illustratively produces three horizontally aligned electron beams which are deflected by a deflection yoke 12, located on tube 10, to form a raster on the phosphor display screen 13 of the cathode ray tube 10. Deflection yoke 12 comprises horizontal deflection coils 14 and vertical deflection coils 15 which respectively deflect the electron beams along horizontal and vertical deflection axes. Yoke 12 may also include a static convergence and purity adjusting device 16, which illustrative is embodied as a fleixble strip of magnetizable material that is magnetized to have magnetic zones of particular strengths and orientation to effect purity and center convergence of the electron beams on the cathode ray tube display screen 13.

The video information signal is illustratively provided to video signal processor 17 via red, green and blue video signal input conductors, designated R, G, B, respectively, from a source of video signals (not shown), such as a computer. The video signal processor generates the red, green and blue color drive signals, that are applied to electron gun assembly 11 via conductors designated DS.

Horizontal and vertical deflection synchronizing (sync) signals, illustratively provided as part of the green video signal on input G, are applied to a sync separator circuit 20, which provides horizontal sync signals to horizontal deflection circuit 21, and vertical sync pulses to vertical deflection circuit 22. Horizontal deflection circuit 21 generates horizontal or line rate deflection current in deflection winding 14. Deflection circuit 21, illustratively of the flyback-type, also produces flyback pulses which are stepped up in voltage by a high voltage circuit 23 which produces the high voltage or ultor potential for cathode ray tube 10. Vertical deflection circuit 22 produces vertical or field rate deflection current in deflection winding 15.

Figure 2:
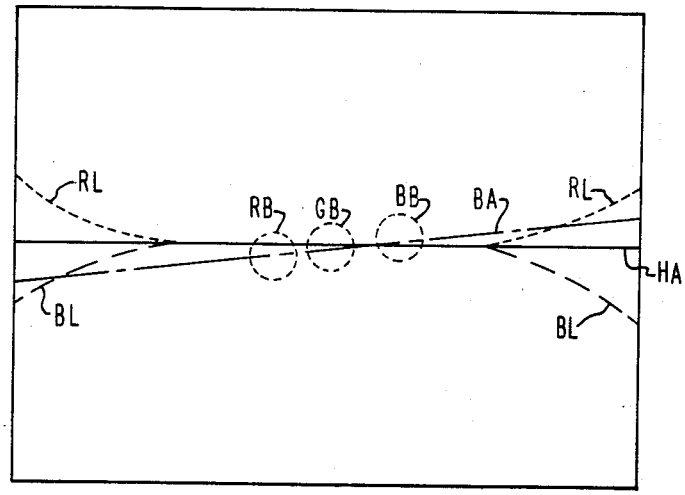
FIG. 2 is a front elevational view of a cathode ray tube display screen illustrating one aspect of deflection distortion.

The electron gun assembly 11 is desirably mounted in the neck of cathode ray tube 10 so that the red, green and blue electron beams, designated RB, GB, BB, respectively, are aligned with the horizontal deflection axis, designated HA in FIG. 2. Due to manufacturing and assembly alignment errors, however, the gun assembly 11 may be mounted in a rotated configuration within the tube neck, so that the beams are actually aligned with line BA. This misalignment of the electron beam axis results in a vertical separation or misconvergence of the horizontal scan lines at the ends of the horizontal axis, so called "blue bow" as shown in FIG. 2. For the misalignment shown in FIG. 2, in which the red beam RB is below the horizontal axis HA the blue beam BB is above the horizontal axis, the misconvergence that results is manifested as the red scan lines RL bowing up and the blue scan lines BL bowing down at the ends of the horizontal axis.

Figure 3:
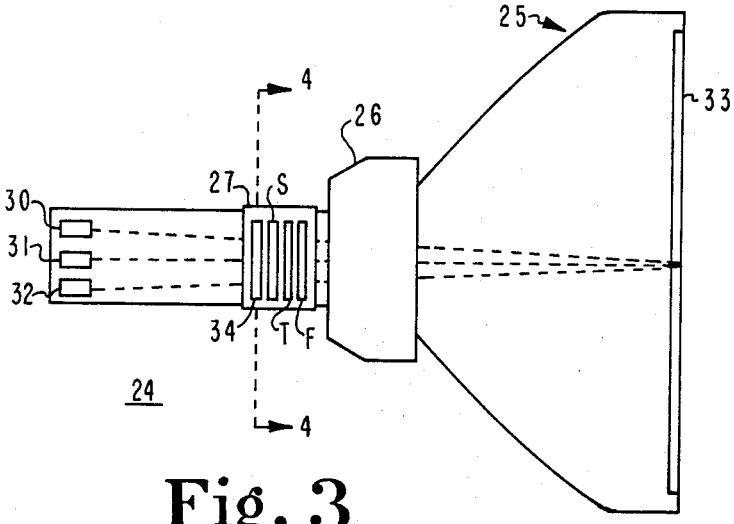
FIG. 3 is a top plan view of a video signal display system incorporating a correction apparatus in accordance with an aspect of the present invention.
Figure 4:
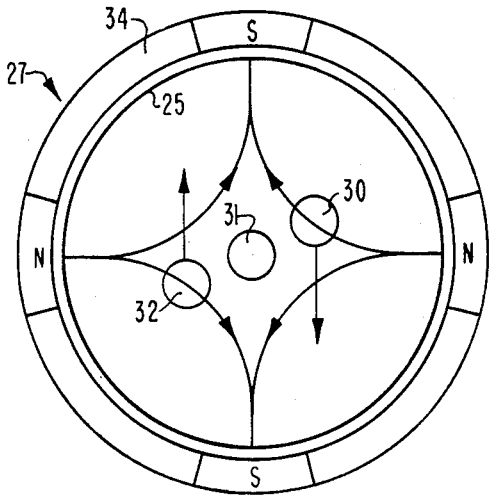
FIG. 4 is a front elevational cross-sectional view of the display system shown in FIG. 3, taken along line 4—4 illustrating the operation of the correction apparatus.

It is known that a four-pole magnetic field can be used to provide vertical movement of the outer, or red and blue, electron beams in a static convergence device such as is described in the aforementioned U.S. Pat. No. 3,725,831. FIG. 3 illustrates a display system 24 comprising a cathode ray tube 25 and a deflection yoke 26, such as that described with reference to FIG. 1. A flexible strip 27 of magnetizable material comprises two-pole, four-pole and six-pole magnetized regions, designated T, F, S, respectively, to effect static or center convergence and purity of the blue, green and red electron beams 30, 31, and 32 on the tube display screen 33. In accordance with an aspect of the present invention, an additional four-pole region 34 is magnetized into strip 27 to effect correction of the previously described blue bow beam separation or misconvergence. The effect of four-pole region 34 is to correct the angle of the beams as they enter the fields produced by deflection yoke 26 as shown in FIG. 4. Since the static convergence four-pole field will also change the angle of the beams, it is desirable for maximum correction effect to provide as much separation as possible between the static convergence four-pole region and the blue-bow four-pole region on strip 27. FIG. 4 illustrates a representative magnetization arrangement for the misalignment shown. A misalignment in which beam 32 is high and beam 36 is low would require reversals of the north and south poles N and S. The strength of the poles is determined by the degree of misalignment, i.e., the amount of misconvergence to be corrected.

Figure 5:
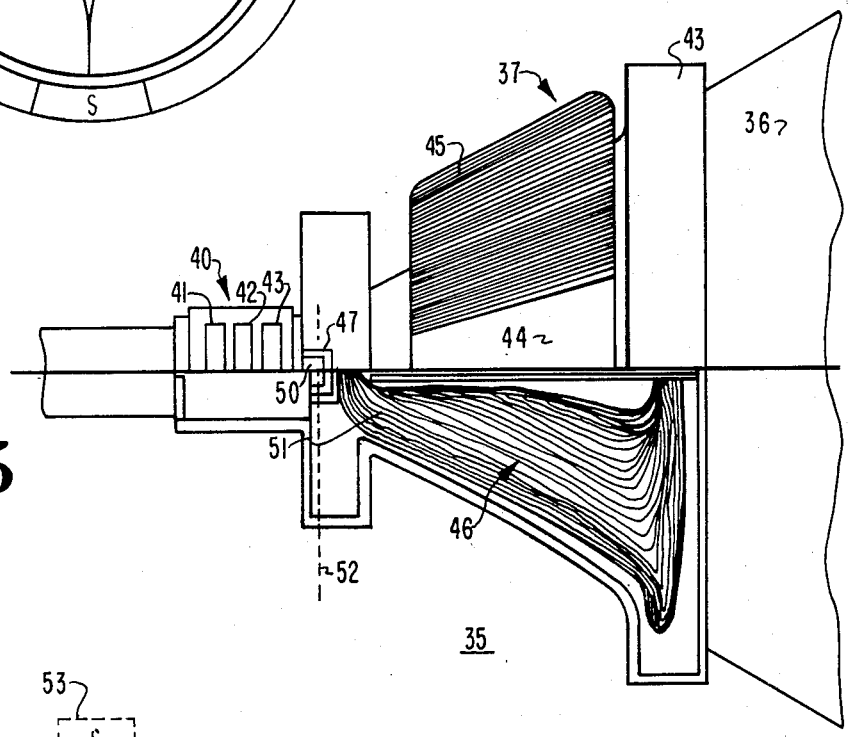
FIG. 5 is a side elevational view, partially in cross-section of a video display system incorporating a correction apparatus in accordance with another aspect of the present invention.

In some display systems utilizing magnetic strip static convergence and purity devices, so called beam-benders, there may be insufficient space on the strip to accommodate an additional magnetic zone, and insufficient space on the deflection yoke or cathode ray tube to add additional strip material. In accordance with a novel aspect of the present invention, FIG. 5 illustrates a display system 35 comprising a cathode ray tube 36 and a deflection yoke 37. A magnetizable strip beam bender 40 located at the rear of yoke 37, includes four, six, and two-pole magnetized zones 41, 42 and 43, respectively, which effectively occupy the entire longitudinal dimension of strip beam bender 40.

Deflection yoke 37 includes a plastic insulator 43 on which is illustratively mounted beam bender 40. In an alternate embodiment, beam bender 40 may be mounted directly to the neck of tube 36. A magnetically permeable core 44 surrounds a portion of insulator 43. Vertical deflection coils 45 are illustratively toroidally wound on core 44. Saddle-type horizontal deflection coils 46 are located along the inside surface of insulator 43, as can be seen in the cut away portion of FIG. 5.

Figure 6:
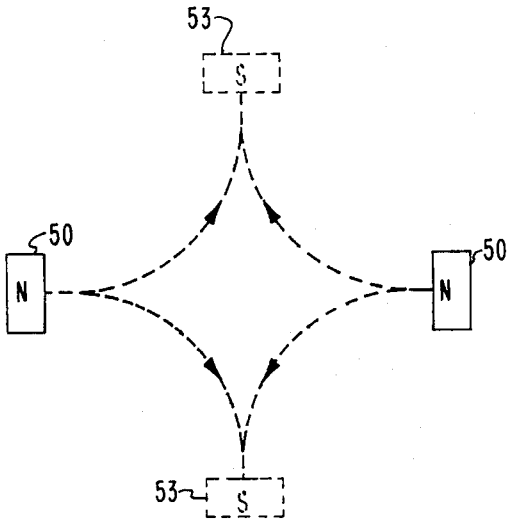
FIG. 6 is a diagrammatic view of the magnetic fields produced by the correction apparatus shown in FIG. 5.

A portion of each side of insulator 43 forms a recess 47 into which is located a rectangular member 50 of magnetizable material, such as the material that comprises beam bender 40. The recess 47, and magnetizable member or piece 50 lies between the angled portions of the end turns 51 of the horizontal deflection coils. Part of member 50 is located forward of the vertical plane 52 defined by the rear of horizontal deflection coils 46. The two members 50, located on opposite sides of the deflection yoke 37, are magnetized in such a manner that two additional ghost or phantom poles 53 are produced, so as to form a four-pole arrangement, such as is illustratively shown in FIG. 6. Only two pieces of magnetizable material are therefore necessary to produce the four-pole field required to effect blue bow correction.

Magnetizable members 50 may be magnetized with structure similar to that used to magnetize strip beam bender 40, such as that described in U.S. Pat. No. 4,390,815, issued June 28, 1983, in the name of C. W. Key, et al., and entitled "Apparatus for Influencing Electron Beam Movement", herein incorporated by reference. The magnetizer described in the above-mentioned patent may be modified to include two additional magnetizing coils extending from the magnetizer in such a way that they are located over members 50 when the magnetizer is brought into position.

The previously described arrangement incorporates separate pieces of magnetizable material for members 50. Members 50 could also be incorporated as part of beam bender strip 40, in which the beam bender material would be formed to resemble in appearance a toothed structure, with predetermined spaced extended portions that would extend into the recesses 47 of insulator 43.

Blue bow correction via magnetizable members 50 may also be accomplished in a display system that utilizes a beam bender comprising individual or discrete magnetic rings, such as that shown in U.S. Pat. No. 3,725,831. In an application of that type, a magnetizer having only two magnetizing coils would be required.

What is claimed is:

1. In a video display apparatus comprising a cathode ray tube having an electron gun assembly for producing a plurality of electron beams, said electron gun assembly subject to alignment errors, a deflection yoke having horizontal and vertical deflection coils, and a source of deflection signals applied to said deflection yoke for deflecting said electron beams along horizontal and vertical deflection axes, said alignment errors causing distortion of said electron beam deflection, means for correcting said distortion comprising:

magnetic material disposed on opposite sides of said cathode ray tube along said horizontal deflection axis, said magnetic material disposed adjacent to the rear of said horizontal deflection coil and magnetized in a manner to produce a four-pole magnetic field in the vicinity of said electron beams.

2. The arrangement defined in claim 1, wherein said alignment error comprises a mounting rotation error of said electron gun assembly.

3. The arrangement defined in claim 2, wherein said deflection distortion comprises blue bow distortion.

4. The arrangement defined in claim 1, wherein said magnetic material is magnetized in a two-pole configuration and wherein said poles interact to form additional poles located along said vertical deflection axis.

5. The arrangement defined in claim 4, wherein said additional poles comprise ghost poles.

6. In a video display apparatus comprising a cathode ray tube having an electron gun assembly for producing a plurality of electron beams, said electron gun assembly subject to alignment errors, a deflection yoke including an insulator and having horizontal and vertical deflection coils, and a source of deflection signals applied to said deflection yoke for deflecting said electron beams along horizontal and vertical deflection axes, said alignment errors causing distortion of said electron beam deflection, means for correcting said distortion comprising:

magnetic material disposed on opposite sides of said cathode ray tube along said horizontal deflection axis, at least a portion of said magnetic material disposed forward of the vertical plane defined by the rear of said horizontal deflection coils, and magnetized in a manner to correct said distortion.

7. The arrangement defined in claim 6, wherein said magnetic material is disposed within a recess formed in said insulator of said deflection yoke.

8. The arrangement defined in claim 6, wherein said magnetic material is disposed between the end turns of said horizontal deflection coils.

9. In a video display apparatus comprising a cathode ray tube having an electron gun assembly for producing a plurality of electron beams, said electron gun assembly subject to alignment errors, a deflection yoke having horizontal and vertical deflection coils, and a source of deflection signals applied to said deflection yoke for deflecting said electron beams along horizontal and vertical deflection axes, said alignment errors causing distortion of said electron beam deflection, means for correcting said distortion comprising:

first and second discrete portions of magnetic material disposed on opposite sides of said cathode ray tube along said horizontal deflection axis, said magnetic material magnetized in a manner to correct said distortion.

10. In a video display apparatus comprising a cathode ray tube having an electron gun assembly for producing a plurality of electron beams, said electron gun assembly subject to alignment errors, a deflection yoke having horizontal and vertical deflection coils, and a source of deflection signals applied to said deflection yoke for deflecting said electron beams along horizontal and vertical deflection axes, said alignment errors causing distortion of said electron beam deflection, means for effecting static convergence of said electron beams comprising:

a magnetizable strip of material disposed about and encircling the neck of said cathode ray tube near the rear of said deflection yoke, said strip of material magnetized to incorporate a plurality of discrete magnetized zones, said zones disposed along the longitudinal axis of said cathode ray tube and magnetized in a manner to effect static convergence and purity of said electron beams, said strip of material comprising at least an additional magnetized zone, magnetized in a manner to correct said distortion of said electron beams caused by said alignment errors of said electron gun assembly.

11. The arrangement defined in claim 10, wherein said alignment error comprises mounting rotation of said electron gun assembly.

12. The arrangement defined in claim 11, wherein said strip of material comprises a two-pole, a first four-pole, and a six-pole magnetized zone, and wherein said additional magnetized zone comprises a second four-pole zone.

13. The arrangement defined in claim 12, wherein said first and second four-pole zones are longitudinally separated by a least one other magnetized zone.

* * * * *